US011749170B2

(12) United States Patent
Sawahata

(10) Patent No.: US 11,749,170 B2
(45) Date of Patent: Sep. 5, 2023

(54) DISPLAY DEVICE WITH OPTIMIZED PROTOCOL FOR SOURCE DRIVER

(71) Applicant: Sharp Display Technology Corporation, Kameyama (JP)

(72) Inventor: Junichi Sawahata, Kameyama (JP)

(73) Assignee: Sharp Display Technology Corporation, Kameyama (JP)

( * ) Notice: Subject to any disclaimer, the term of this patent is extended or adjusted under 35 U.S.C. 154(b) by 0 days.

(21) Appl. No.: 18/080,581

(22) Filed: Dec. 13, 2022

(65) Prior Publication Data

US 2023/0196969 A1 Jun. 22, 2023

Related U.S. Application Data

(60) Provisional application No. 63/292,390, filed on Dec. 21, 2021.

(51) Int. Cl.
*G09G 3/20* (2006.01)

(52) U.S. Cl.
CPC ..... *G09G 3/2092* (2013.01); *G09G 2310/08* (2013.01); *G09G 2370/08* (2013.01)

(58) Field of Classification Search
CPC ..... G09G 3/2092
See application file for complete search history.

(56) References Cited

U.S. PATENT DOCUMENTS

2016/0232874 A1* 8/2016 Matsuda ..... G09G 5/006
2020/0294453 A1 9/2020 Watanabe
2022/0328014 A1 10/2022 Watanabe

FOREIGN PATENT DOCUMENTS

JP 2020148915 A 9/2020

* cited by examiner

*Primary Examiner* — Gustavo Polo
(74) *Attorney, Agent, or Firm* — ScienBiziP, P.C.

(57) ABSTRACT

A display device according to aspect of the disclosure includes: a source driver; and a timing controller. The source driver and the timing controller perform data communication through serial transmission. The display device further includes a storage unit configured to store information about each of a plurality of standards that are different from each other, the standard defining a protocol for specific serial transmission. The timing controller selects one standard from among the plurality of standards, performs first determination that is determination on the selected standard to determine whether to receive a lock signal from the source driver within a predetermined period after training pattern data compatible with the selected standard is output to the source driver, and outputs an image signal of the protocol of the selected standard to the source driver when a result of the first determination is positive.

14 Claims, 11 Drawing Sheets

| | | | |
|---|---|---|---|
| 101 | TRAINING PATTERN 1 (STANDARD A) | BIT/PACKET | 11 |
| | | NUMBER OF PACKETS | 2 |
| | | PATTERN 1 | 0x2AA |
| | | PATTERN 2 | 0x555 |
| | | PATTERN 3 | - |
| 102 | TRAINING PATTERN 2 (STANDARD B) | BIT/PACKET | 11 |
| | | NUMBER OF PACKETS | 2 |
| | | PATTERN 1 | 0x783 |
| | | PATTERN 2 | 0x783 |
| | | PATTERN 3 | - |
| 103 | TRAINING PATTERN 3 (STANDARD C) | BIT/PACKET | 28 |
| | | NUMBER OF PACKETS | 1 |
| | | PATTERN 1 | 0xFFFC001 |
| | | PATTERN 2 | - |
| | | PATTERN 3 | - |
| 104 | TRAINING PATTERN 4 (STANDARD D) | BIT/PACKET | 24 |
| | | NUMBER OF PACKETS | 1 |
| | | PATTERN 1 | 0xFFF001 |
| | | PATTERN 2 | - |
| | | PATTERN 3 | - |

FIG. 5

DISPLAY DEVICE WITH OPTIMIZED PROTOCOL FOR SOURCE DRIVER

CROSS-REFERENCE TO RELATED APPLICATION

The present application claims priority from U.S. Provisional Application No. 63/292,390, filed Dec. 21, 2021, the entire content of which are hereby incorporated by reference into this application.

BACKGROUND

1. Field

The disclosure described below relates to a display device.

2. Description of the Related Art

Japanese Unexamined Patent Publication No. 2020-148915, for example, discloses a display device that performs clock training in order to stably fix the phase and frequency of the internal clock for data communication between a timing controller and a source driver.

SUMMARY

Incidentally, there are a plurality of standards for a protocol of serial transmission employed in data communication between a timing controller and a source driver. Although the source driver is designed based on a specific standard so as to correctly restore an image signal of the protocol of a compatible standard, it normally cannot correctly restore image signals of protocols of incompatible standards. Thus, the timing controller needs to output, to the connected source driver, image signals of the protocol of the standard compatible with the source driver. For this reason, even though work of rewriting settings of the timing controller is required in manufacturing of a display device so that image signals of the protocol of an appropriate standard are output depending on the type of source driver connected to the timing controller, this work is time-consuming.

An aspect of the disclosure aims to save time and effort when rewriting the settings of a timing controller for each panel with a different type of source driver in manufacturing of a display device.

(1) A display device according to an embodiment of the present disclosure includes a source driver and a timing controller, which is a display device in which the source driver and the timing controller perform data communication through serial transmission, the display device further including a storage unit that stores information about each of a plurality of standards that are different from each other, the standard defining a protocol for specific serial transmission, in which the timing controller selects one standard from among the plurality of standards, performs first determination that is determination on the selected standard to determine whether to receive a lock signal from the source driver within a predetermined period after training pattern data compatible with the selected standard is output to the source driver, and outputs an image signal of the protocol of the selected standard to the source driver when a result of the first determination is positive.

(2) In addition, in a certain embodiment of the present disclosure, in addition to the configuration of (1) described above, if the result of the first determination is negative, the timing controller selects one standard that is not yet selected from among the plurality of standards and performs the first determination.

(3) In addition, in a certain embodiment of the present disclosure, in addition to the configuration of (1) or (2) described above, the timing controller selects one standard that is not yet selected from among the plurality of standards and repeatedly performs the first determination until a positive result is obtained in the first determination.

(4) In addition, in a certain embodiment of the present disclosure, in addition to the configuration of any of (1) to (3) described above, after the output of the image signal, the timing controller performs second determination to determine whether a locked state of data communication between the timing controller and the source driver is released, and when a result of the second determination is positive, the timing controller selects the first selected standard from among the plurality of standards to perform the first determination.

(5) In addition, in a certain embodiment of the present disclosure, in addition to the configuration of any of (1) to (3) described above, the timing controller performs second determination to determine whether a locked state of data communication between the timing controller and the source driver is released, and when a result of the second determination is positive, the timing controller selects a compatible standard that is a standard for which a positive result is obtained in the first determination before the locked state is released and performs the first determination.

(6) In addition, in a certain embodiment of the present disclosure, in addition to the configuration of (5) described above, the timing controller selects the compatible standard again to perform the first determination even when a negative result is obtained in the first determination for the compatible standard.

(7) In addition, in a certain embodiment of the present disclosure, in addition to the configuration of (1) to (6) described above, the timing controller selects one standard from among the plurality of standards according to a predetermined selection order.

(8) In addition, in a certain embodiment of the present disclosure, in addition to the configuration of (7) described above, the selection order is an order stored in the storage unit, or an order in which information about each of the plurality of standards is stored in the storage unit.

(9) In addition, in a certain embodiment of the present disclosure, in addition to the configuration of any of (1) to (6) described above, the storage unit further stores a priority of each of the plurality of standards, and the timing controller selects one standard from among the plurality of standards according to the priority of each of the plurality of standards.

(10) In addition, in a certain embodiment of the present disclosure, in addition to the configuration of (7) described above, when the result of the first determination is positive and the priority of the selected standard is not the highest priority, the timing controller changes the priority of the selected standard to the highest priority.

(11) In addition, in a certain embodiment of the present disclosure, in addition to the configuration of (1) to (10) described above, the information about each of the plurality of standards includes first information about training pattern data of each of the plurality of standards, and the timing controller generates training pattern data compatible with the selected standard based on the first information, and outputs the generated training pattern data to the source driver.

(12) In addition, in a certain embodiment of the present disclosure, in addition to the configuration of (11) described above, the first information includes at least one of the number of packets, the number of bits per packet, and a data pattern of each packet of the training pattern data of each of the plurality of standards.

(13) In addition, in a certain embodiment of the present disclosure, in addition to the configuration of any of (1) to (12) described above, the information about each of the plurality of standards includes second information about an image signal of a protocol of each of the plurality of standards, and the timing controller outputs an image signal of a protocol of the selected standard based on the second information to the source driver.

(14) In addition, in a certain embodiment of the present disclosure, in addition to the configuration of (13) described above, the second information includes the number of bits of RGB image data for the protocol of each of the plurality of standards.

According to an aspect of the disclosure, time and effort when rewriting settings of the timing controller for each panel with a different type of source driver can be saved in manufacturing of a display device.

BRIEF DESCRIPTION OF DRAWINGS

FIG. 5 is a diagram illustrating a specific example of first information about the training pattern data of the plurality of standards A to D.

DETAILED DESCRIPTION

First Embodiment

Configuration of Display Device 1

Figure 1:
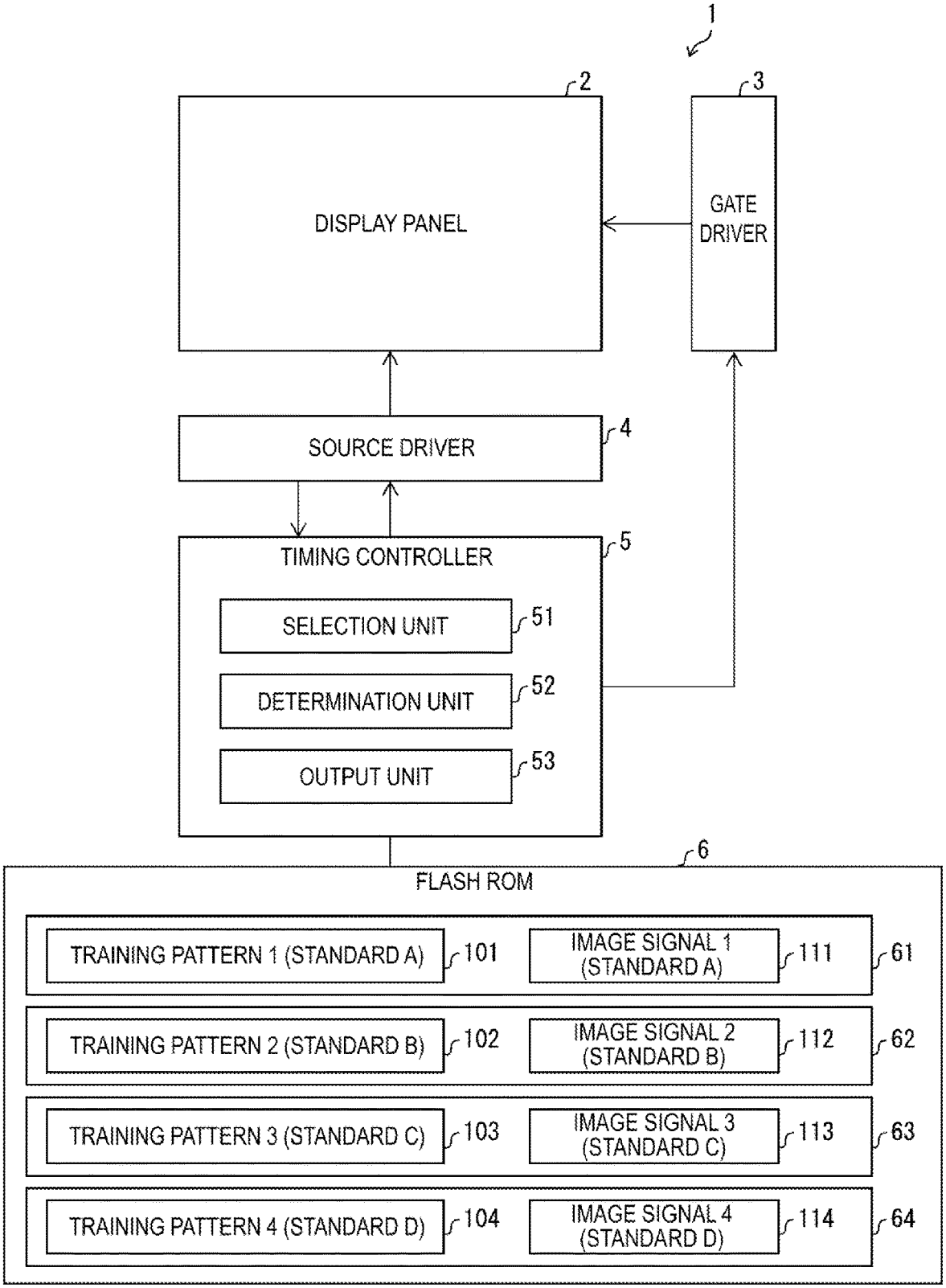
FIG. 1 is a diagram illustrating a configuration of a display device according to a first embodiment of the present disclosure.

FIG. 1 is a diagram illustrating a configuration of a display device 1 according to a first embodiment of the present disclosure. As illustrated in this drawing, the display device 1 includes at least a display panel 2, a gate driver 3, a source driver 4, a timing controller 5, and a flash ROM 6 (an example of a storage unit). The timing controller 5 includes a selection unit 51, a determination unit 52, and an output unit 53.

The display panel 2 is any display panel such as a liquid crystal display panel which can display various types of information. The gate driver 3 outputs a drive signal for driving the display panel 2 to the display panel 2. The source driver 4 outputs an image signal indicating an image to be displayed on the display panel 2 to the display panel 2. The timing controller 5 outputs a signal required for the display panel 2 for driving and image display to the gate driver 3 and the source driver 4.

The source driver 4 is compatible with any of a plurality of different standards (the four standards A to D in the present embodiment) defining the protocol for a specific serial transmission. The flash ROM 6 is a type of a non-volatile memory, and stores information necessary for operations of the timing controller 5. For example, the flash ROM 6 stores information 61 to information 64 for each of the plurality of different standards A to D defining the protocol for a specific serial transmission. The information 61 to information 64 for each of the standards A to D include first information 101 to first information 104 about the training pattern data of the respective standards A to D as illustrated in FIG. 1. Furthermore, the information 61 to information 64 for each of the standards A to D further include second information 111 to second information 114 about image signals of the protocols of the plurality of respective standards A to D.

Serial Communication Example

Figure 2:
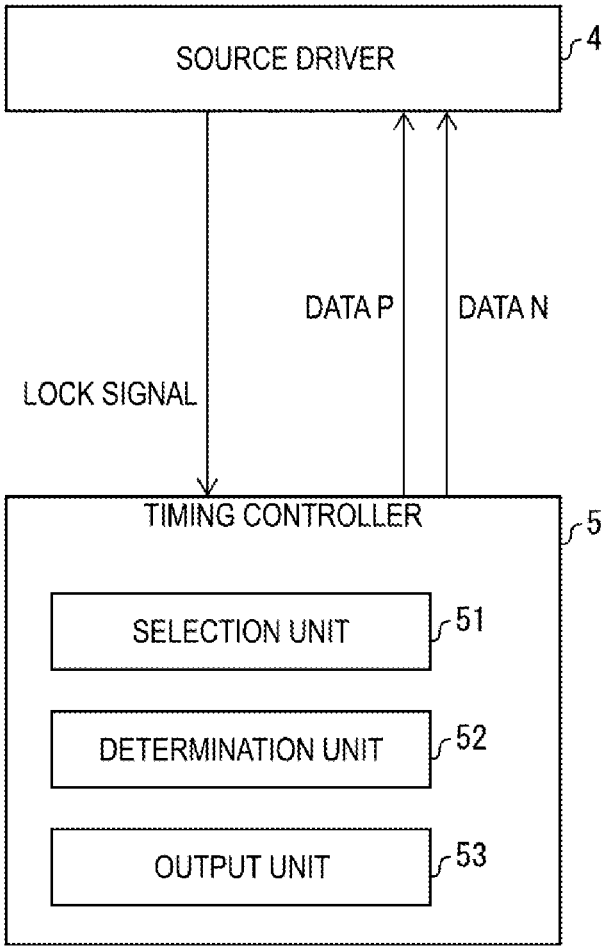
FIG. 2 is a diagram illustrating serial communication between a source driver and a timing controller.

FIG. 2 is a diagram illustrating serial communication between the source driver 4 and the timing controller 5. Data communication between the source driver 4 and the timing controller 5 is performed through clock-embedded serial transmission as illustrated in this drawing. Data P and Data N are a pair of differential signals, respectively corresponding to a positive-side signal and a negative-side signal. Data N is a signal obtained by inverting the polarity of Data P. The timing controller 5 outputs the same data to the source driver 4 using Data P and Data N. That is, both Data P and Data N include training pattern data, preamble data, image signals, and the like.

The training pattern data is data used in clock training (clock recovery) executed by the source driver 4. The source driver 4 performs clock training using the training pattern data to stably fix (locks) the phase and frequency of the internal clock of the source driver 4. Upon receiving the training pattern data output from the timing controller 5, the source driver 4 performs a clock training using the training pattern data. When the source driver 4 succeeds in clock training, a serial communication interface between the source driver 4 and the timing controller 5 switches from an unlocked state to a locked state.

In the present embodiment, if the clock training is successful, the source driver 4 outputs a lock signal indicating that the serial communication interface is in the locked state to the timing controller 5. The timing controller 5 can ascertain that the serial communication interface is in the locked state by receiving the lock signal.

Details of Serial Communication

Figure 3:
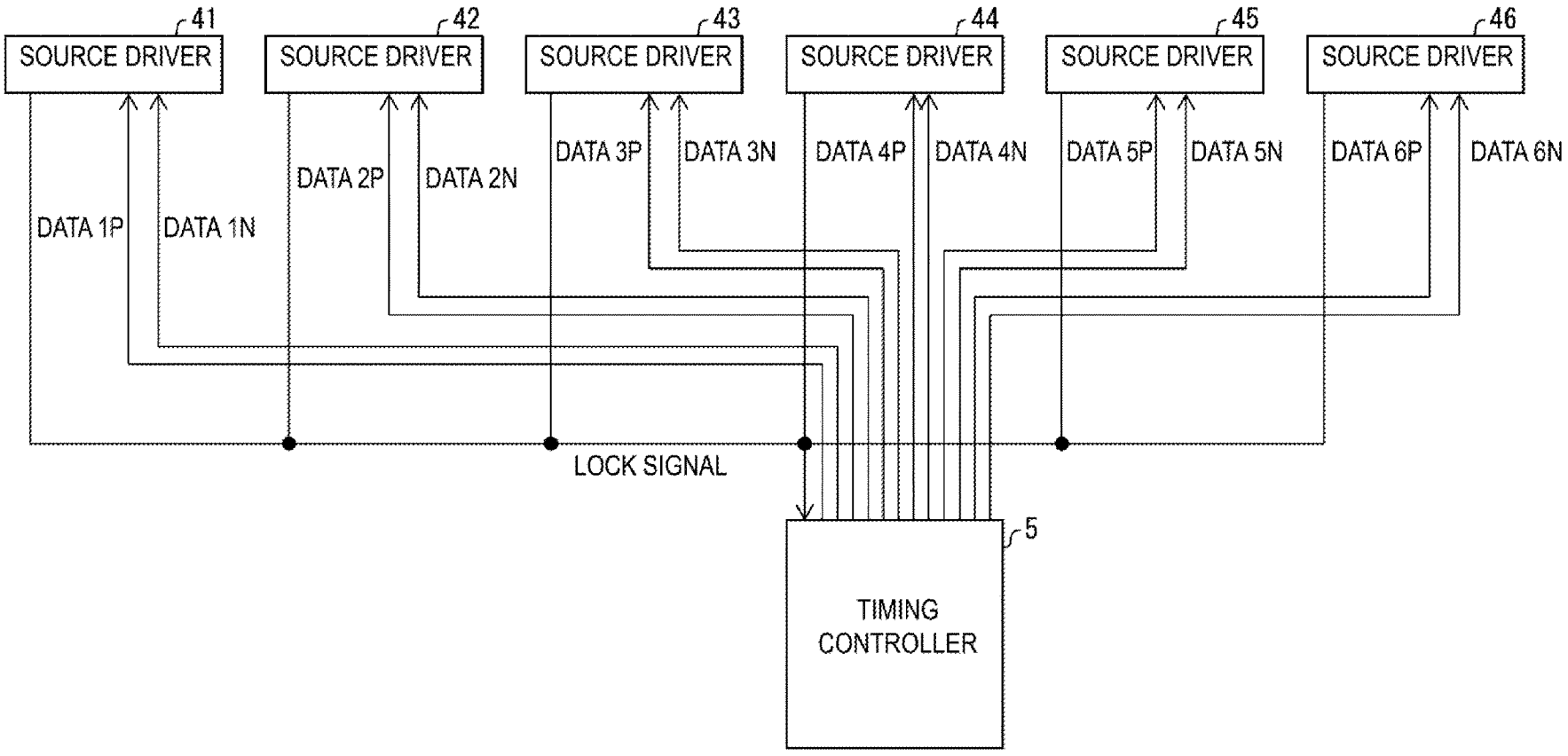
FIG. 3 is a diagram illustrating serial communication between a source driver and a timing controller in detail.

FIG. 3 is a diagram illustrating serial communication between the source driver 4 and the timing controller 5 in detail. The source driver 4 of the present embodiment is actually constituted by a plurality of different source drivers as illustrated in this drawing. In the example of FIG. 3, the source driver 4 is constituted by six source drivers 41 to 46. Each of the source drivers 41 to 46 is responsible for supplying image data to pixel groups at different portions of the display panel 2.

The timing controller 5 outputs compatible data signals Data P and data signals Data N to each of the source drivers 41 to 46. For example, the source driver 41 receives output of a data signal Data 1P and a data signal Data 1N for the source driver 41. Similarly, the source drivers 42 to 46 receive output of data signals Data 2P to Data 6P and data signals Data 2N to Data 6N for the source drivers 42 to 46, respectively. When clock training is successful, each of the source drivers 41 to 46 individually outputs a lock signal to the timing controller 5. In addition, the timing controller 5 collectively receives the lock signals from the source drivers 41 to 46 according to wired AND logic.

The source driver 4 is designed based on a standard defining the protocol of a specific serial transmission. The source driver 4 can correctly restore image data for image signals output according to the protocol based on the standard compatible with the source driver 4. Conversely, the source driver 4 normally cannot correctly restore image data for image signals output according to the protocol based on other standards incompatible with the source driver 4. Thus, the timing controller 5 needs to output image signals according to the protocol compatible with the standard of the source driver 4 to the source driver 4 in order to cause the display panel 2 to display images.

Example of Training Pattern Data

Figure 4:
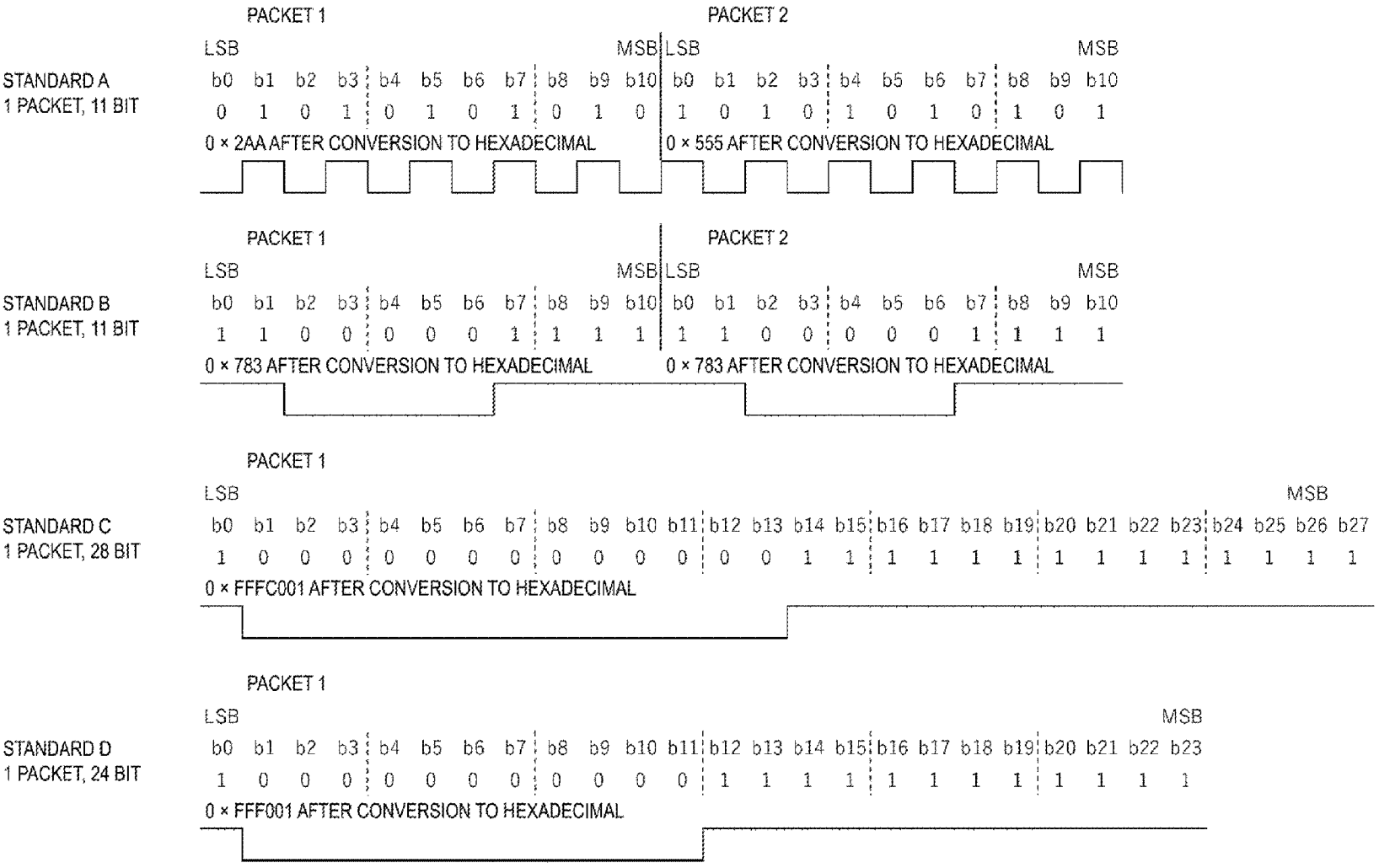
FIG. 4 is a diagram illustrating training pattern data compatible with each of different standards A to D.

FIG. 4 is a diagram illustrating training pattern data compatible with each of the different standards A to D. The training pattern data of the standards A to D are different patterns as illustrated in FIG. 4.

The training pattern data of the standard A is composed of a packet 1 and a subsequent packet 2. All of the packets 1 and 2 are data with a length of 11 bits. The training pattern data of the standard A has a pattern in which every one bit has the inverted bit value. The value of the first bit (b0) of the packet 1 is 0, and the value of the first bit (b0) of the packet 2 is 1. The bit pattern of the packet 1 of the training pattern data of the standard A converted to hexadecimal is 0x2AA, and the bit pattern of the packet 2 of the training pattern data of the standard A converted to hexadecimal is 0x555.

The training pattern data of the standard B is composed of a packet 1 and a subsequent packet 2. All of the packets 1 and 2 are data with a length of 11 bits. The training pattern data of the standard B has a pattern that the value of the first two bits is 1, the value of the subsequent five bits is 0, the value of the subsequent six bits is 1, the value of the subsequent five bits is 0, and the value of the subsequent four bits is 1. Each bit pattern of the packets 1 and 2 of the training pattern data of the standard B converted to hexadecimal is 0x783.

The training pattern data of the standard C is composed only of a packet 1. The packet 1 is data with a length of 28 bits. The training pattern data of the standard C has a pattern that the value of the first bit is 1, the value of the subsequent 13 bits is 0, and the value of the subsequent 14 bits is 1. The bit pattern of the packet 1 of the training pattern data of the standard C converted to hexadecimal is 0xFFFC001.

The training pattern data of the standard Discomposed only of a packet 1. The packet 1 is data with a length of 24 bits. The training pattern data of the standard D has a pattern that the value of the first bit is 1, the value of the subsequent 11 bits is 0, and the value of the subsequent 12 bits is 1. The bit pattern of the packet 1 of the training pattern data of the standard D converted to hexadecimal is 0xFFF001.

The training pattern data of each standard has different patterns according to the standards as illustrated in FIG. 4. The source driver 4 can perform the clock training of the source driver 4 correctly by using training pattern data of the compatible standard. That is, if clock training is performed using training pattern data of the compatible standard, the source driver 4 succeeds in the clock training. On the other hand, clock training is not successful even if clock training is performed using training pattern data of an incompatible standard.

Specific Example of First Information 101 to First Information 104

FIG. 5 is a diagram illustrating a specific example of the first information 101 to the first information 104 about the training pattern data of the plurality of standards A to D. The first information 101 to the first information 104 include at least one of the number of packets, the number of bits per packet, and the data pattern of each packet of the training pattern data of each of the plurality of standards A to D as illustrated in FIG. 5. More specifically, the first information 101 to the first information 104 include the number of bits of each packet constituting the training pattern data of the plurality of standards A to D, the number of packets included in the training pattern data, and the value of bits composing each packet expressed in hexadecimal. By configuring the first information 101 to the first information 104 as illustrated in FIG. 5, the first information 101 to the first information 104 about the training pattern data of the different standards can be stored in the common flash ROM 6.

The second information 111 to the second information 114 (see FIG. 1) include, for example, the number of bits of RGB image data for the protocol of each of the plurality of standards A to D.

Flow of Process by Timing Controller 5

Figure 6:
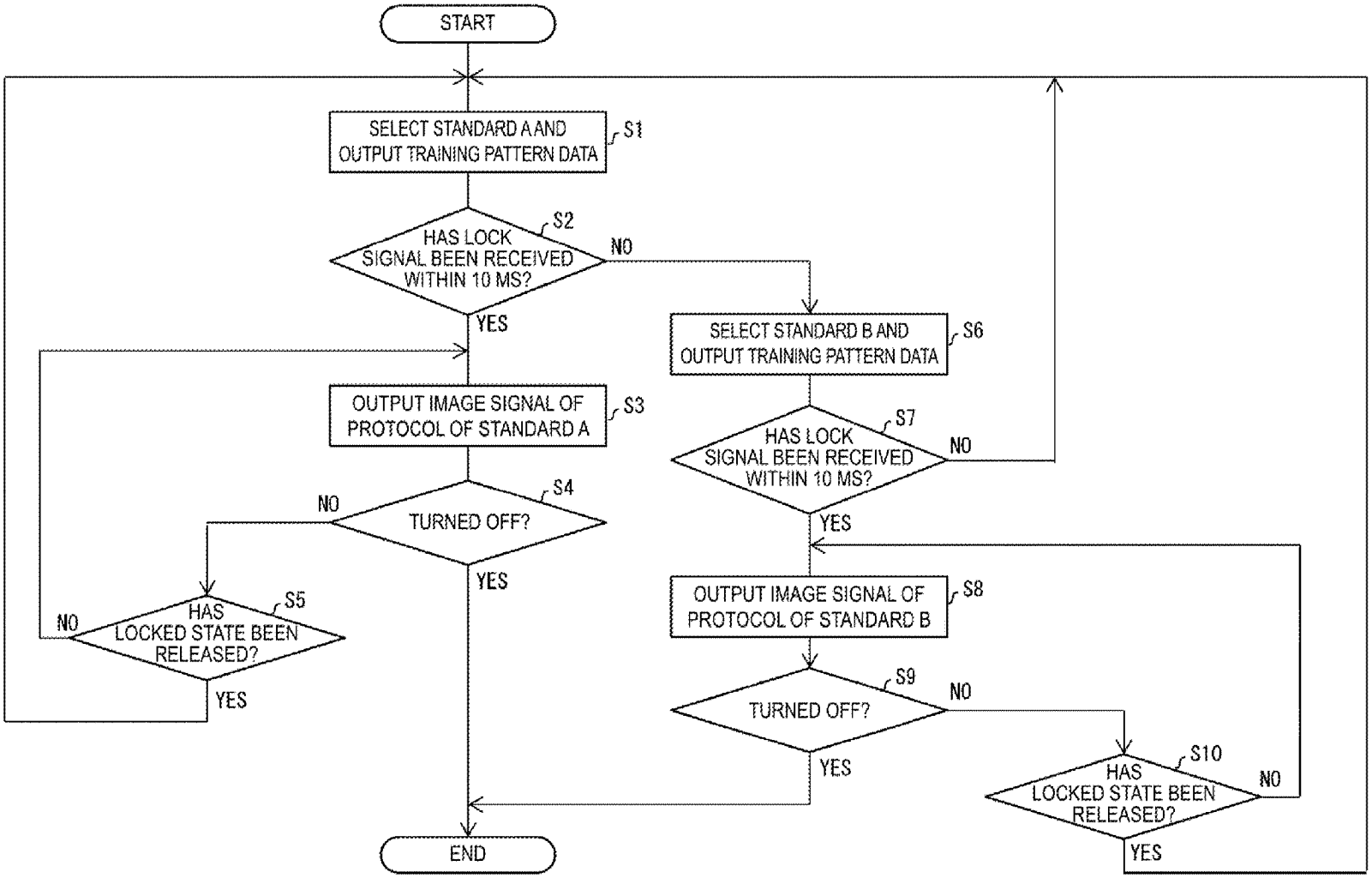
FIG. 6 is a flowchart illustrating the flow of a series of processes performed by the timing controller according to the first embodiment of the present disclosure.

FIG. 6 is a flowchart illustrating the flow of a series of processes performed by the timing controller 5 according to the first embodiment of the present disclosure. FIG. 6 is an example in a case in which information 61 and information 62 about two standards (the standard A and the standard B) are stored in the flash ROM 6. In the example of FIG. 6, the timing controller 5 determines whether the source driver 4 is compatible with any of the standards A and B. The timing controller 5 outputs image signals according to the protocol based on the suitable standard compatible with the source driver 4 to the source driver 4.

Before the series of processes shown in FIG. 6 is started, the timing controller 5 reads the first information 101 and the first information 102 from the flash ROM 6, and stores the first information in advance in an internal memory of the timing controller 5. In step S1, the timing controller 5 selects one standard from among the plurality of standards when driving the display panel 2. In the present embodiment, the selection unit 51 selects one standard from among the plurality of standards in accordance with predetermined selection order. The selection order of each standard may be stored in the flash ROM 6, for example, or may be the order in which the information 61 to the information 64 about each of the plurality of standards is stored in the flash ROM 6. In the example shown in FIG. 6, the information indicating that the standard A is first selected and then the standard B is selected next is stored in the flash ROM 6.

Thereafter, the output unit 53 outputs the training pattern data of the one selected standard (here, the standard A) to the source driver 4. In more detail, the output unit 53 reads the first information 101 about the training pattern data of the selected standard A from the internal memory of the timing controller 5. Then, the output unit 53 generates training pattern data compatible with the selected standard A based on the read first information 101, and outputs the generated training pattern data to the source driver 4.

The source driver 4 performs clock training using the received training pattern data. If the clock training is successful, the source driver 4 outputs a lock signal indicating that the serial communication interface between the source driver 4 and the timing controller 5 is in a locked state, to the timing controller 5. On the other hand, if the clock training is not successful, the lock signal is not output to the timing controller 5.

In step S2, the determination unit 52 performs first determination to determine whether to receive a lock signal from the source driver 4 within a predetermined period of time (10 ms in the present embodiment) after the training pattern data of the standard A is output. If the result of the first determination in step S2 is positive (YES), the determination unit 52 determines that the source driver 4 is compatible with the standard A. In this way, in step S3, the output unit 53 outputs the image signal of the protocol of the standard A to the source driver 4. Specifically, the output unit 53 reads the second information 111 about the image signal of the protocol of the standard A from the flash ROM 6. Then, the output unit 53 generates the image signal of the protocol of the standard A based on the read second information 111, and outputs the image signal to the source driver 4. The source driver 4 decodes the image data by analyzing the received image signal.

Further, before the series of processes shown in FIG. 6 is started, the timing controller 5 may read the second information 111 and the second information 112 from the flash ROM 6, and stores the second information in advance in the internal memory of the timing controller 5. In this case, in step S3, the output unit 53 may read the second information 111 about the image signal of the protocol of the standard A from the internal memory of the timing controller 5.

Figure 7:
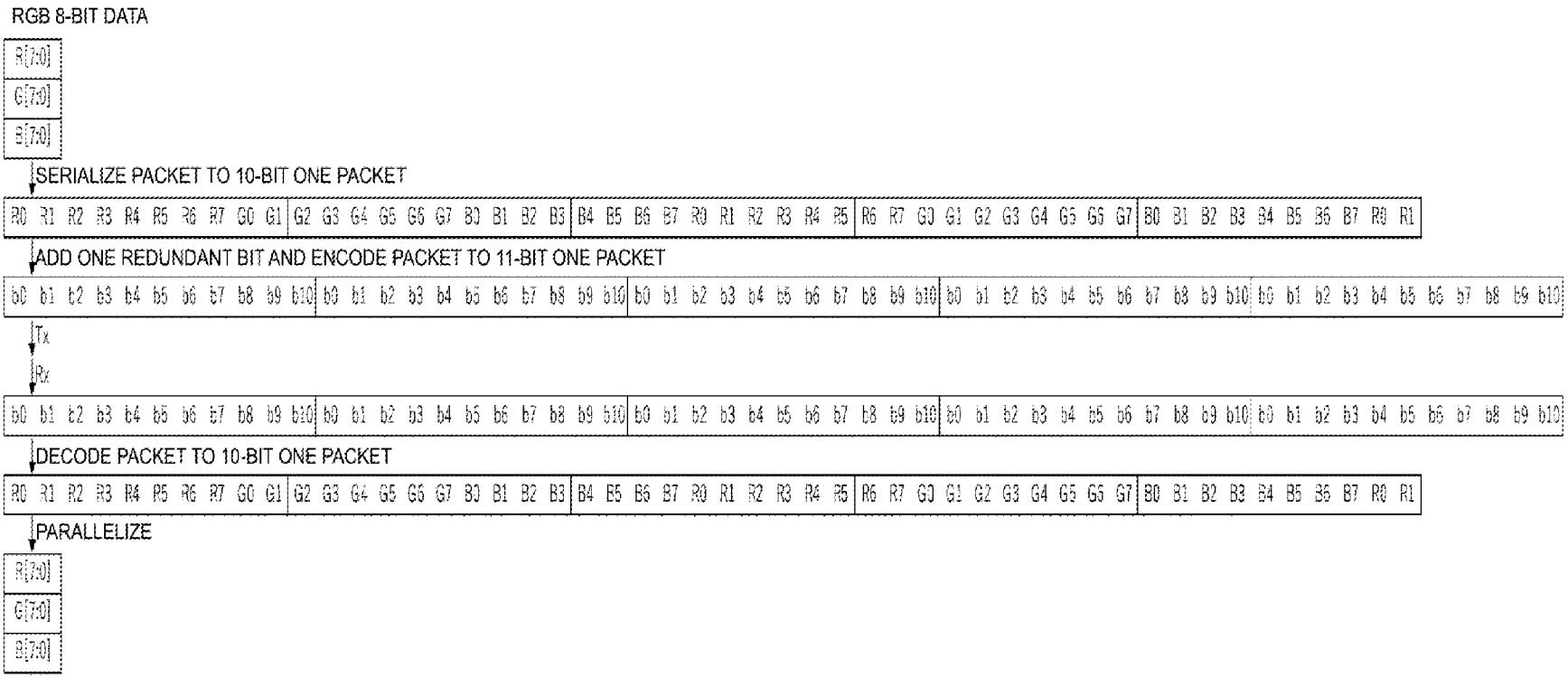
FIG. 7 is a diagram illustrating an example of image signals of a protocol of the standard A.

FIG. 7 is a diagram illustrating an example of an image signal of the protocol of the standard A. In this example of the drawing, the standard A defines 8-bit RGB image data. The output unit 53 serializes the 8-bit RGB image data into one 10-bit packet based on the protocol of the standard A. The output unit 53 further encodes each packet to have a 11-bit length by adding a 1-bit redundancy bit to each packet. The output unit 53 outputs each encoded 11-bit packet to the source driver 4 through the serial communication interface. The source driver 4 decodes each 11-bit packet received from the timing controller 5 into each 10-bit packet. The source driver 4 further obtains 8-bit RGB image data by parallelizing each decoded 10-bit packet.

After the output of the image signal of the protocol of the standard A, the determination unit 52 determines whether the display device 1 has been turned off in step S4. If the result of the determination of step S4 is positive (YES), the series of processes shown in FIG. 6 ends.

After the serial communication interface is in the locked state, the locked state may be released for any reason. When the locked state is released, the output unit 53 cannot output an image signal to the source driver 4. Thus, if the result of the determination in step S4 is negative (N0), the determination unit 52 performs second determination to determine whether the locked state of the serial communication interface has been released in step S5.

The determination unit 52 makes the second determination to determine whether the locked state has been released based on whether the potential of a wiring line (hereinafter referred to as a "lock wiring line") for outputting a lock signal on the output side (as a "timing controller 5 side") is any of "High" or "Low". In the present embodiment, the potential of the lock wiring line on the output side being "High" corresponds to a state in which the lock signal has been output. If the potential of the lock wiring line on the output side is "High", the determination unit 52 determines that the locked state is maintained, and if the potential of the lock wiring line on the output side is "Low", the determination unit 52 determines that the locked state has been released.

The plurality of source drivers 41 to 46 are connected to the timing controller 5 using the wired AND method. Thus, when the locked state is released in the at least one of the source drivers 41 to 46, the potential of the lock wiring line on at least one input side (at least one of the source drivers 41 to 46 side) changes to "Low". Thus, the potential of the lock wiring line on the output side is "Low". On the other hand, if all of the plurality of source drivers 41 to 46 are in the locked state, the potential of the lock wiring line on all of the input side (all of the plurality of source drivers 41 to 46 side) becomes "High", and the potential of the lock wiring line on the output side becomes "High" as well. Further, pull-up resistance is connected to the lock wiring line.

If the result of the second determination in step S5 is negative (NO), that is, if the serial communication interface maintains the locked state, the process of FIG. 6 returns to step S3. In this way, the output unit 53 outputs a new image signal (for example, signal of the next frame) of the protocol of the standard A to the source driver 4. In this way, the timing controller 5 continues to output the image signal of the protocol of the standard A to the source driver 4 while the serial communication interface is determined to maintain the locked state. Thus, the display device 1 can continue to display the image.

If the result of the second determination in step S5 is positive (YES), that is, if the locked state of the serial communication interface is determined to be released, the series of processes of FIG. 6 returns to step S1. In this way, the determination unit 52 selects the standard A that was selected first among the plurality of standards to make the first determination. As a result, the output unit 53 resumes the output of the image signal of the standard A when the source driver 4 succeeds in the clock training.

If the result of the determination in step S2 is negative (NO), the determination unit 52 determines that the source driver 4 is incompatible with the standard A. In this way, in step S6, the selection unit 51 selects one standard that has not yet been selected from among the plurality of standards, and outputs the training pattern data of the one selected standard to the source driver 4. In more detail, first, the selection unit 51 selects the standard B from the standards A and B. Next, the output unit 53 reads the first information 102 about training pattern data of the selected standard B from the internal memory of the timing controller 5. Then, the output unit 53 generates training pattern data compatible with the selected standard B based on the read first information 102, and outputs the generated training pattern data to the source driver 4.

The source driver 4 performs clock training using the received training pattern data. If the clock training is successful, the source driver 4 outputs a lock signal indicating that the serial communication interface between the source driver 4 and the timing controller 5 is in a locked state to the timing controller 5. On the other hand, if the clock training is not successful, the lock signal is not output to the timing controller 5.

In step S7, the determination unit 52 performs first determination to determine whether to receive a lock signal from the source driver 4 within a predetermined period of time (10 ms in the present embodiment) after the training pattern data of the standard B is output. If the result of the determination in step S7 is positive (YES), the determination unit 52 determines that the source driver 4 is compatible with the standard B. In this way, in step S8, the output unit 53 outputs the image signal of the protocol of the standard B to the source driver 4. Specifically, the output unit 53 reads the second information 112 about the image signal of the protocol of the standard B from the flash ROM 6. Then, the output unit 53 generates the image signal of the protocol of the standard B based on the read second information 112, and outputs the image signal to the source driver 4. The source driver 4 decodes the image data by analyzing the received image signal.

Figure 8:
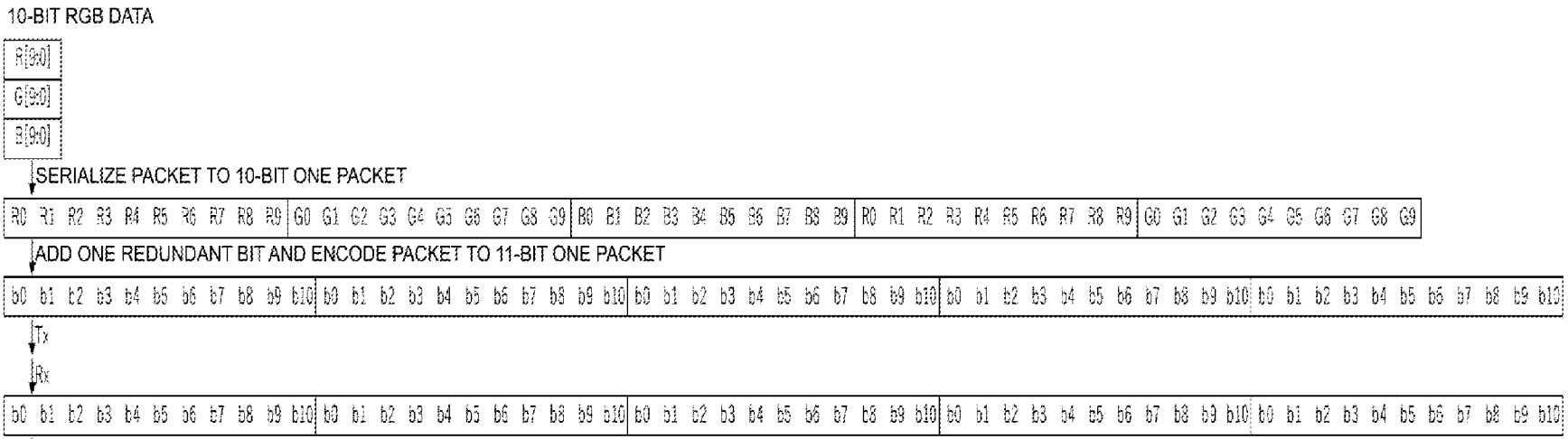
FIG. 8 is a diagram illustrating an example of image signals of a protocol of the standard B.

FIG. 8 is a diagram illustrating an example of image signals of a protocol of the standard B. In this example of the drawing, the standard B defines 10-bit RGB image data. The output unit 53 serializes the 10-bit RGB image data into one 10-bit packet based on the protocol of the standard B. The output unit 53 further encodes each packet to have a 11-bit length by adding a 1-bit redundancy bit to each packet. The output unit 53 outputs each encoded 11-bit packet to the source driver 4 through the serial communication interface. The source driver 4 decodes each 11-bit packet received from the timing controller 5 into each 10-bit packet. The source driver 4 further obtains 10-bit RGB image data by parallelizing each decoded 10-bit packet.

As illustrated in FIG. 7 and FIG. 8, the standard A and the standard B differ in the number of bits of the RBG image data. If the standard of the timing controller 5 on the output side and the standard of the source driver 4 on the reception side do not match, the source driver 4 cannot correctly restore the image data simply due to a difference in the number of bits of the image data. Therefore, the timing controller 5 needs to output image signals of the protocol of the standard A to the source driver 4 compatible with the standard A, and output image signals of the protocol of the standard B to the source driver 4 compatible with the standard B.

After the output of the image signal of the protocol of the standard B, the determination unit 52 determines whether the display device 1 has been turned off in step S9. If the result of the determination of step S9 is positive (YES), the series of processes shown in FIG. 6 ends.

After the serial communication interface is in the locked state, the locked state may be released for any reason. When the locked state is released, the output unit 53 cannot output an image signal to the source driver 4. Thus, if the result of the determination in step S9 is negative (NO), the determination unit 52 performs second determination to determine whether the locked state of the serial communication interface has been released in step S10. If the result of the determination in step S10 is negative (NO), that is, if it is determined that the serial communication interface maintains the locked state, the process of FIG. 6 returns to step S8. In this way, the output unit 53 outputs a new image signal (for example, signal of the next frame) of the protocol of the standard B to the source driver 4. In this way, the timing controller 5 continues to output the image signal of the protocol of the standard B to the source driver 4 while the serial communication interface maintains the locked state. Thus, the display device 1 can continue to display the image.

If the result of the second determination in step S10 is positive (YES), that is, if the locked state of the serial communication interface is determined to be released, the series of processes shown in FIG. 6 returns to step S1. In this way, the timing controller 5 selects the standard A selected first from among the plurality of standards to make first determination. At this time, since the source driver 4 is compatible with the standard B, the source driver 4 cannot be locked even if the training pattern data of the standard A is used. As a result, since the result of the first determination performed by selecting the standard A is negative, the series of processes shown in FIG. 6 proceeds to step S7, and the timing controller 5 selects the standard B again to make the first determination.

Main Effects

As described above, if it is determined that the source driver 4 is compatible with the standard A, the timing controller 5 outputs an appropriate image signal based on the protocol of the standard A to the source driver 4. On the other hand, if it is determined that the source driver 4 is compatible with the standard B, an appropriate image signal based on the protocol of the standard B is output to the source driver 4. In this way, the timing controller 5 automatically determines the standard for the source driver 4, and automatically sets information about the determined standard in the timing controller 5. Accordingly, time and effort when rewriting the settings of the timing controller for each panel with a different type of source driver can be saved in manufacturing. As a result, a work load during the manufacturing can be reduced.

If it is determined that the locked state of the serial communication interface has been released after the image signal is output to the source driver 4, the timing controller 5 further outputs the training pattern data compatible with the first selected standard A to the source driver 4. In this way, the timing controller 5 can make the first determination from the first selected standard A again even if the locked state is released, and can automatically determine the standard for the source driver 4 again. As a result, the timing controller 5 can return the serial communication interface between the timing controller and the source driver 4 to the locked state.

The timing controller 5 can determine which of three or more standards the source driver 4 is compatible with. For example, the standard C can be added further to the standard A and the standard B described above, as a standard to be determined by the timing controller 5. In the present example, if the source driver 4 is determined not to be compatible with the standard B, the timing controller 5 next selects the standard C, and determines whether the source driver 4 is compatible with the standard C.

Specifically, in this example, the information 61 to information 63 about the respective three standards (standards A to C) are stored in the flash ROM 6. Before the series of processes shown in FIG. 6 is started, the timing controller 5 reads the first information 101 to the first information 103 from the flash ROM 6, and stores the first information in advance in the internal memory of the timing controller 5. If the result of the determination in step S7 is negative (NO), the timing controller 5 further selects the standard C and makes the first determination.

In other words, the timing controller 5 repeats selecting the standard that has not been selected from among the plurality of standards and performing the first determination until a positive result is obtained in the first determination. If the information 61 to the information 64 for each of the four standards (standard A to D) are stored in the flash ROM 6 as illustrated in FIG. 1, the timing controller 5 selects, for example, the standard D that has not yet been selected and performs the first determination if the standard C was selected and the result of the first determination was negative.

Further, in the example of FIG. 6, when the serial communication interface is not in the locked state even if the training pattern data of the standard A is used or the training pattern data of the standard B is used, the selection of the standard A is repeated. Thus, if the source driver 4 is not successful in clock training, the series of processes shown in FIG. 6 continues to loop. However, the locked state of the serial communication interface may be released by adjusting the output of the training pattern data that is a differential signal, and thus there is no particular problem even if the series of processes shown in FIG. 6 continues to loop.

Additionally, in the example of FIG. 6, if the source driver 4 is compatible with neither the standard A nor the standard B, the source driver 4 is not successful in the clock training, and thus the serial communication interface will never be in a locked state. In this case, although the series of processes shown in FIG. 6 loops forever with no images displayed, this loop state is not particularly problematic for the display device 1.

Modified Example

Figure 9:
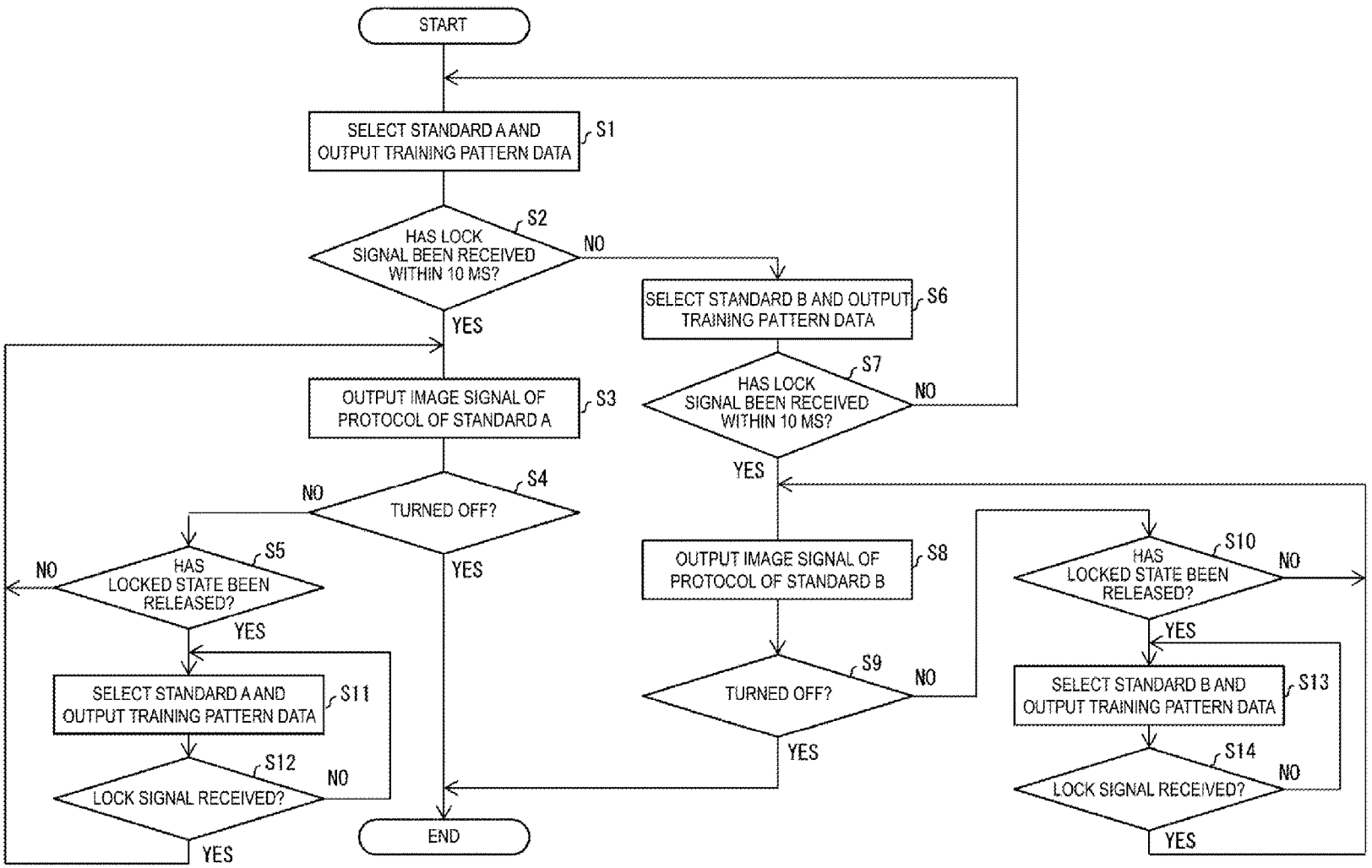
FIG. 9 is a flowchart illustrating a modified example of the flow of the series of processes performed by the timing controller according to the first embodiment of the present disclosure.

FIG. 9 is a flowchart illustrating a modified example of the flow of the series of processes performed by the timing controller 5 according to the first embodiment of the present disclosure. Each of the processes from steps S1 to S10 shown in this drawing is the same as that in steps S1 to S10 shown in FIG. 6, and thus detailed descriptions thereof will be omitted. In the present modified example, if it is determined that the locked state of the serial communication interface has been released after the standard of the source driver 4 is confirmed, the timing controller 5 outputs the training pattern data of the same standard as that used immediately before the locked state was released to the source driver 4.

In detail, if the result of the second determination in step S5 is positive (YES), in other words, if the locked state of the serial communication interface is released while the standard A is being used, in step S11, the timing controller 5 selects the compatible standard (here, the standard A), which is the standard for which a positive result was obtained in the first determination before the locked state was released, and outputs the training pattern data of the selected standard A to the source driver 4 as illustrated in FIG. 9. In step S12, the determination unit 52 performs first determination to determine whether to receive a lock signal from the source driver 4 after the training pattern data of the standard A is output.

If the result of the first determination in step S12 is positive (YES), the determination unit 52 determines that the source driver 4 is compatible with the standard A, and the process of FIG. 9 returns to step S3. In this way, the output unit 53 outputs a new image signal (for example, signal of the next frame) of the protocol of the standard A to the source driver 4. In this way, the output unit 53 continues to output the image signal of the protocol of the standard A to the source driver 4 when the locked state is set again even after the locked state of the serial communication interface was released once. Thus, the display device 1 can continue to display the image.

If the result of the first determination in step S12 is negative (NO), the process of FIG. 9 returns to step S11. In this way, the timing controller 5 selects the standard A again and performs the first determination. In this way, the timing controller 5 selects the compatible standard and performs the first determination again even if a negative result is obtained in the first determination for the compatible standard (here, the standard A). In this way, the timing controller 5 selects the standard A and repeatedly performs the first determination until a positive result is obtained in the first determination for the standard A.

In addition, if the result of the second determination in step S10 is positive (YES), in other words, if the locked state of the serial communication interface is released while the standard B is being used, in step S13, the selection unit 51 selects the compatible standard (here, the standard B), which is the standard for which a positive result was obtained in the first determination before the locked state was released, and outputs the training pattern data of the selected standard B to the source driver 4, as illustrated in FIG. 9. In step S14, the determination unit 52 performs first determination to determine whether to receive a lock signal from the source driver 4 after the training pattern data of the standard B is output.

If the result of the first determination in step S14 is positive (YES), the determination unit 52 determines that the source driver 4 is compatible with the standard B, and the process of FIG. 9 returns to step S8. In this way, the output unit 53 outputs a new image signal (for example, signal of the next frame) of the protocol of the standard B to the source driver 4. In this way, the timing controller 5 continues to output the image signal of the protocol of the standard B to the source driver 4 when the locked state is reset even after the locked state of the serial communication interface is released once. Thus, the display device 1 can continue to display the image.

If the result of the second determination in step S14 is negative (NO), the process of FIG. 9 returns to step S13. In this way, the timing controller 5 selects the standard B again and performs the first determination. In this way, the timing controller 5 selects the compatible standard and performs the first determination again even if a negative result is obtained in the first determination for the compatible standard (here, the standard B). In this way, the timing controller 5 selects the standard B and repeatedly performs the first determination until a positive result is obtained in the first determination for the standard B.

According to the modified example described above, if it is determined that the locked state of the serial communication interface has been released after the image signal of the protocol of the standard A is output to the source driver 4, the timing controller 5 selects the compatible standard (here, the standard A) that is the standard for which a positive result was obtained in the first determination before the locked state was released, and performs the first determination. In this way, since a positive result is likely to be obtained in the first determination for the newly selected standard A, the locked state of the serial communication interface can be quickly restored.

Likewise, if it is determined that the locked state of the serial communication interface has been released after the image signal of the protocol of the standard B is output to the source driver 4, the timing controller 5 selects the compatible standard (here, the standard B) that is a standard for which a positive result was obtained in the first determination before the locked state was released, and performs the first determination. In this way, since a positive result is likely to be obtained in the first determination for the newly selected standard B, the locked state of the serial communication interface can be quickly restored.

Second Embodiment

Configuration of Display Device 1A

Figure 10:
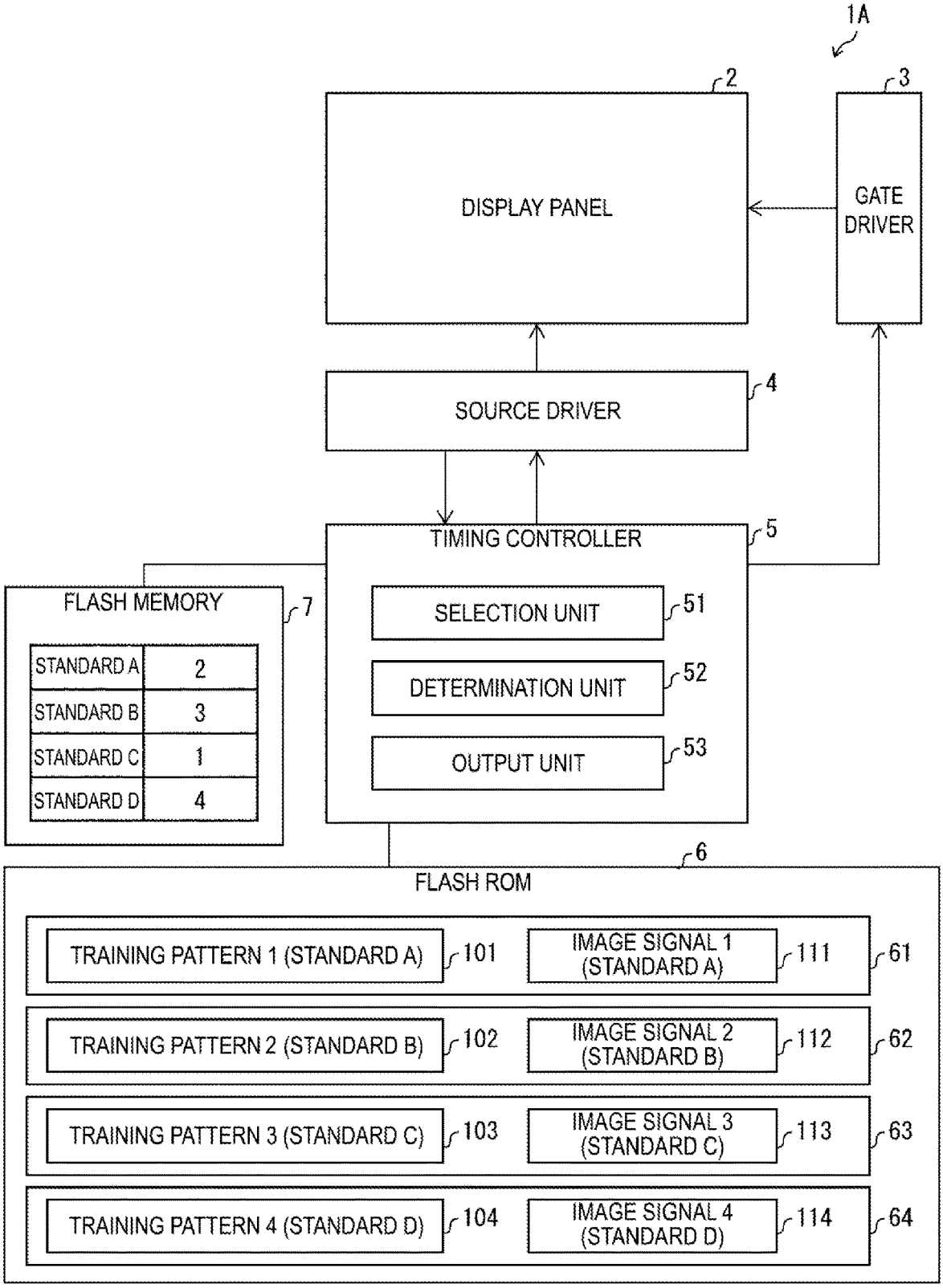
FIG. 10 is a diagram illustrating a configuration of a display device according to a second embodiment of the present disclosure.

FIG. 10 is a diagram illustrating a configuration of a display device 1A according to a second embodiment of the present disclosure. As illustrated in this drawing, the display device 1A includes at least a display panel 2, a gate driver 3, a source driver 4, a timing controller 5, a flash ROM 6, and a flash memory 7 (an example of a storage unit). In other words, the display device 1A has a configuration in which the flash memory 7 is further added to the display device 1 according to the first embodiment.

The flash memory 7 is a type of non-volatile memory which can rewrite information. As illustrated in FIG. 10, the flash memory 7 stores a priority of each of the plurality of standards A to D. In the flash memory 7, the respective priorities of the plurality of standards A to D are individually associated with the names of the plurality of standards A to D. In the present embodiment, the priority of each of the standards A to D is a numerical value such as "1", "2", "3", "4", and the like. In the present embodiment, the timing controller 5 selects one standard from among the plurality of standards A to D according to the respective priorities of the plurality of standards. In this way, the training pattern data of the standard with a higher priority is more preferentially output to the source driver 4.

Flow of Process by Timing Controller 5

Figure 11:
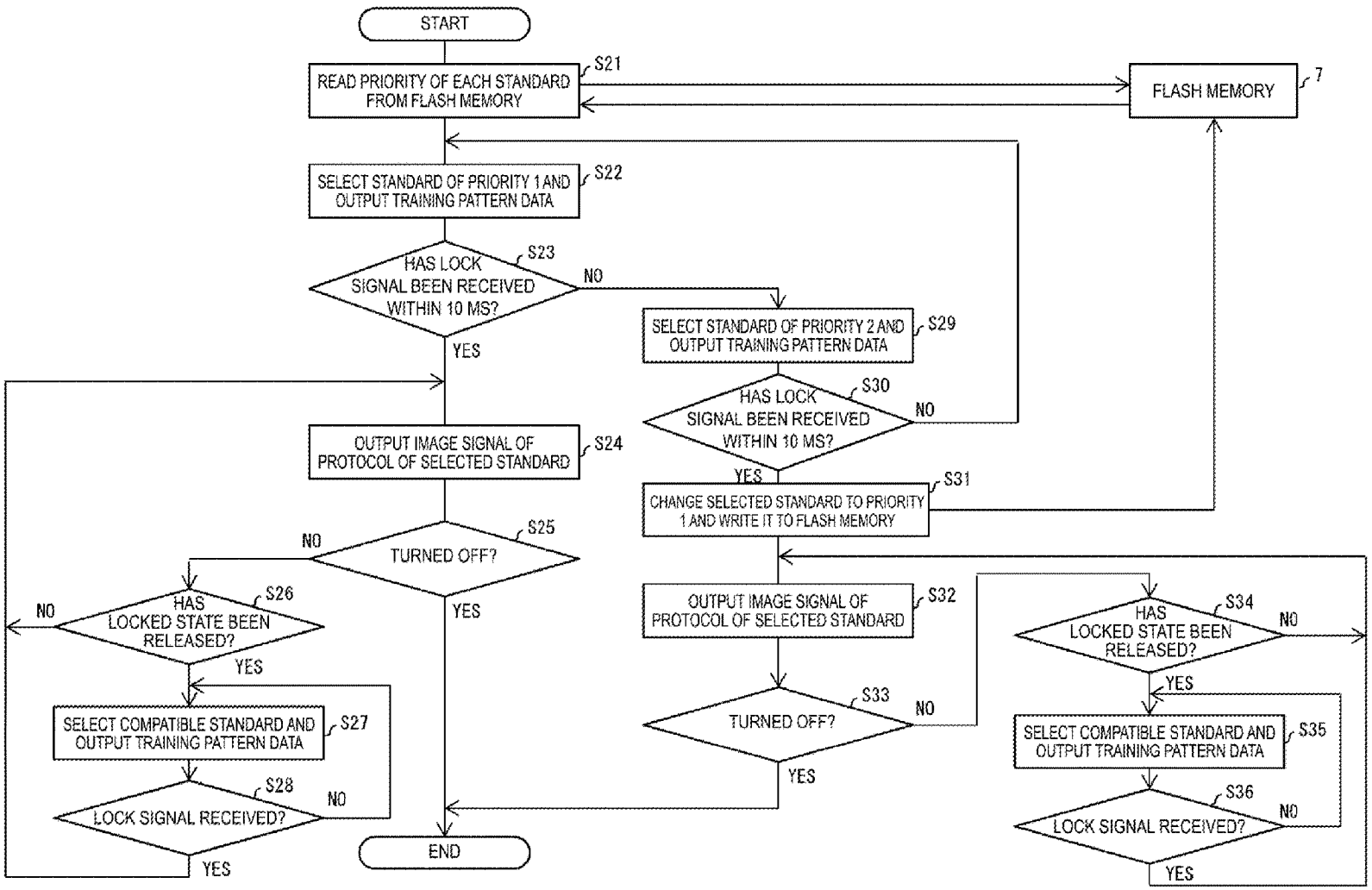
FIG. 11 is a flowchart illustrating the flow of a series of processes performed by a timing controller according to the second embodiment of the present disclosure.

FIG. 11 is a flowchart illustrating the flow of a series of processes performed by the timing controller 5 according to the second embodiment of the present disclosure. FIG. 11 is an example of a case in which information 61 and information 63 about each of two standards (the standard A and the standard C) are stored in the flash ROM 6. In addition, FIG. 11 is also of an example in which the priority of each of the two standards (the standards A and C) is stored in the flash memory 7. Before the series of processes shown in FIG. 11 is started, the timing controller 5 reads the first information 101 and the first information 103 from the flash ROM 6, and stores the first information in advance in an internal memory of the timing controller 5.

In step S21, the selection unit 51 reads the priority of each of the standards A and C from the flash memory 7. In step S22, the timing controller 5 selects the standard of the priority 1, and outputs the training pattern data of the selected standard to the source driver 4. The priority 1 corresponds to the highest priority "1". As illustrated in FIG. 10, the standard with the priority 1 is the standard C.

Specifically, first, the selection unit 51 selects the standard C with the priority 1 among the standards A and C. Next, the output unit 53 reads the first information 103 about the training pattern data of the selected standard C from the internal memory of the timing controller 5. Then, the output unit 53 generates training pattern data compatible with the selected standard C based on the read first information 103, and outputs the generated training pattern data to the source driver 4.

The source driver 4 performs clock training using the received training pattern data of the standard C. If the clock training is successful, the source driver 4 outputs a lock signal indicating that the serial communication interface between the source driver 4 and the timing controller 5 is in a locked state to the timing controller 5. On the other hand, if the clock training is not successful, the lock signal is not output to the timing controller 5.

In step S23, the determination unit 52 performs first determination to determine whether to receive a lock signal from the source driver 4 within a predetermined period of time (10 ms in the present embodiment) after the training pattern data of the selected standard C is output. If the result of the first determination in step S23 is positive (YES), the output unit 53 outputs the image signal of the protocol of the selected standard C to the source driver 4 in step S24. Specifically, the output unit 53 reads the second information 113 about the image signal of the protocol of the selected standard C from the flash ROM 6. Then, the output unit 53 generates the image signal of the protocol of the standard C based on the read second information 113, and outputs the image signal to the source driver 4. The source driver 4 decodes the image data by analyzing the received image signal.

After the output of the image signal of the protocol of the selected standard C, the determination unit 52 determines whether the display device 1A has been turned off in step S25. If the result of the determination of step S25 is positive (YES), the series of processes shown in FIG. 11 ends.

Thus, if the result of the determination in step S25 is negative (NO), the determination unit 52 performs second determination to determine whether the locked state of the serial communication interface has been released in step S26. If the result of the second determination in step S26 is negative (NO), that is, if the serial communication interface maintains the locked state, the process of FIG. 11 returns to step S24. In this way, the output unit 53 outputs a new image signal (for example, signal of the next frame) of the protocol of the selected standard C to the source driver 4. In this way, the timing controller 5 continues to output the image signal of the protocol of the standard C to the source driver 4 while the serial communication interface maintains the locked state. Thus, the display device 1A can continue to display the image.

If the result of the second determination in step S26 is positive (YES), in other words, if the locked state of the serial communication interface is determined to have been released, the timing controller 5 selects the compatible standard (here, the standard C), and outputs the training pattern data of the selected standard C to the source driver 4 in step S27. In step S28, the determination unit 52 performs first determination to determine whether to receive a lock signal from the source driver 4 after the training pattern data of the selected standard C is output.

If the result of the first determination in step S28 is positive (YES), the determination unit 52 determines that the source driver 4 is compatible with the selected standard C, and the process of FIG. 11 returns to step S24. In this way, the output unit 53 outputs a new image signal (for example, signal of the next frame) of the protocol of the selected standard C to the source driver 4. In this way, the timing controller 5 continues to output the image signal of the protocol of the standard C to the source driver 4 when the locked state is reset even after the locked state of the serial communication interface is released once. Thus, the display device 1A can continue to display the image.

If the result of the first determination in step S28 is negative (NO), the process of FIG. 11 returns to step S27. In this way, the timing controller 5 selects the standard C again and performs the first determination. In this way, the timing controller 5 selects the compatible standard and performs the first determination again even if a negative result is obtained in the first determination for the compatible standard (here, the standard C). In this way, the timing controller 5 selects the standard C and repeatedly performs the first determination until a positive result is obtained in the first determination for the standard C.

If the result of the first determination in step S23 is negative (NO), the determination unit 52 determines that the source driver 4 is incompatible with the standard C with the priority 1. Thus, the selection unit 51 selects the standard with the priority 2, and outputs the training pattern data of the selected standard to the source driver 4 in step S29. The priority 2 means the second highest priority "2". In other words, the priority 2 is one level lower than the priority 1. As illustrated in FIG. 10, the standard with the priority 2 is the standard A.

Specifically, first, the selection unit 51 selects the standard A with the priority 2 among the standards A and C. Next, the output unit 53 reads the first information 101 about the training pattern data of the selected standard A from the internal memory of the timing controller 5. Then, the output unit 53 generates training pattern data compatible with the selected standard A based on the read first information 101, and outputs the generated training pattern data to the source driver 4.

The source driver 4 performs clock training using the received training pattern data of the standard A. If the clock training is successful, the source driver 4 outputs a lock signal indicating that the serial communication interface between the source driver 4 and the timing controller 5 is in a locked state to the timing controller 5. On the other hand, if the clock training is not successful, the lock signal is not output to the timing controller 5.

In step S30, the determination unit 52 performs first determination to determine whether to receive a lock signal from the source driver 4 within a predetermined period of time (10 ms in the present embodiment) after the training pattern data of the selected standard A is output. If the result of the first determination in step S30 is negative (NO), the determination unit 52 determines that the source driver 4 is incompatible with the standard A with the priority 2. As a result, the process shown in FIG. 11 returns to step S22. In this way, the timing controller 5 selects the standard C with the priority 1 again and performs the first determination. If the source driver 4 does not succeed in the clock training using training pattern data of the standard with the priority 1 or priority 2, the series of processes shown in FIG. 11 continues to loop.

If the result of the first determination in step S30 is positive (YES), the determination unit 52 determines that the source driver 4 is compatible with the standard A with the priority 2. If the priority of the selected standard A (i. e., the standard determined to be compatible with the source driver 4) is not the highest priority, the selection unit 51 changes the priority of the selected standard A to the highest priority. Specifically, in step S31, the selection unit 51 changes the standard A with the priority 2 to the priority 1, and writes the changed priority to the flash memory 7. As a result, the priority of the standard A stored in the flash memory 7 is updated from the priority 2 to the priority 1. Furthermore, the selection unit 51 changes the priority of the standard C to a value different from the priority 1. For example, the priority of the standard C is changed from the priority 1 to the priority 2, and the changed priority of the standard C may be written into the flash memory 7.

In step S32, the output unit 53 outputs the image signal of the protocol of the selected standard A (the standard A that has newly ranked on the priority 1) to the source driver 4. Specifically, the output unit 53 reads the second information 111 about the image signal of the protocol of the selected standard A from the flash ROM 6. Then, the output unit 53 generates the image signal of the protocol of the standard A based on the read second information 111, and outputs the image signal to the source driver 4. The source driver 4 decodes the image data by analyzing the received image signal.

After the output of the image signal of the protocol of the selected standard A, the determination unit 52 determines whether the display device 1A has been turned off in step S33. If the result of the determination of step S33 is positive (YES), the series of processes shown in FIG. 11 ends. Thus, if the result of the determination in step S33 is negative (NO), the determination unit 52 performs second determination to determine whether the locked state of the serial communication interface has been released in step S34.

If the result of the second determination in step S34 is negative (NO), that is, if the serial communication interface maintains the locked state, the process of FIG. 11 returns to step S32. Thus, the output unit 53 outputs a new image signal (for example, signal of the next frame) of the protocol of the selected standard A to the source driver 4. In this way, the timing controller 5 continues to output the image signal of the protocol of the standard A to the source driver 4 while the serial communication interface maintains the locked state. Thus, the display device 1A can continue to display the image.

If the result of the second determination in step S34 is positive (YES), in other words, if the locked state of the serial communication interface is determined to have been released, the timing controller 5 selects the compatible standard (here, the standard A), and outputs the training pattern data of the selected standard A to the source driver 4 in step S35. In step S36, the determination unit 52 performs first determination to determine whether a lock signal has been received from the source driver 4 after the training pattern data of the selected standard A is output.

If the result of the first determination in step S36 is positive (YES), the determination unit 52 determines that the source driver 4 is compatible with the selected standard A, and the process of FIG. 11 returns to step S32. Thus, the output unit 53 outputs a new image signal (for example, signal of the next frame) of the protocol of the selected standard A to the source driver 4. In this way, the timing controller 5 continues to output the image signal of the protocol of the standard A to the source driver 4 when the locked state is reset even after the locked state of the serial communication interface is released once. Thus, the display device 1 can continue to display the image.

If the result of the first determination in step S36 is negative (NO), the process of FIG. 11 returns to step S35. As a result, the timing controller 5 re-selects the compatible standard (here, the standard A) to perform first determination. Thus, the timing controller 5 repeatedly outputs the training pattern data of the standard A to the source driver 4 until a positive result is obtained in the first determination for the standard A.

Main Effects

In the present embodiment, the timing controller 5 checks whether the frequently used standard is compatible with the source driver 4 from among the plurality of standards by giving the highest priority to the last used standard. Typically, the standard of the source driver 4 connected to the timing controller 5 is not frequently changed. For this reason, the timing controller 5 can ascertain whether the standard that is most likely to be compatible with the source driver 4 is compatible with the source driver 4, and thus can reduce the time required to confirm the standard compatible with the source driver 4. As a result, the time required to start communication with the source driver 4 is reduced, and thus the time required until display of the image begins can also be shortened.

The present invention is not limited to each of the embodiments described above, and various modifications may be implemented within a range not departing from the scope of the claims. Embodiments obtained by appropriately combining technical approaches stated in each of the different embodiments also fall within the scope of the technology of the present invention. Novel technical features may also be formed by combining the technical approaches stated in each of the embodiments.

What is claimed is:

1. A display device comprising:

a source driver; and a timing controller, the source driver and the timing controller performing data communication through serial transmission, the display device further comprising a storage unit configured to store information about each of a plurality of standards that are different from each other, the standard defining a protocol for specific serial transmission, wherein the timing controller selects one standard from among the plurality of standards, performs first determination that is determination on the selected standard to determine whether to receive a lock signal from the source driver within a predetermined period after training pattern data compatible with the selected standard is output to the source driver, and outputs an image signal of the protocol of the selected standard to the source driver when a result of the first determination is positive.

2. The display device according to claim 1, wherein, when the result of the first determination is negative, the timing controller selects one standard that is not yet selected from among the plurality of standards and performs the first determination.

3. The display device according to claim 1, wherein the timing controller repeats selecting a standard that is not yet selected from among the plurality of standards and performing the first determination until a positive result is obtained in the first determination.

4. The display device according to claim 1, wherein, after the output of the image signal, the timing controller performs second determination to determine whether a locked state of data communication between the timing controller and the source driver is released, and when a result of the second determination is positive, the timing controller selects the first selected standard from among the plurality of standards to perform the first determination.

5. The display device according to claim 1, wherein, after the output of the image signal, the timing controller performs second determination to determine whether a locked state of data communication between the timing controller and the source driver is released, and when a result of the second determination is positive, the timing controller selects a compatible standard that is a standard for which a positive result is obtained in the first determination before the locked state is released and performs the first determination.

6. The display device according to claim 5, wherein the timing controller selects the compatible standard again to perform the first determination even when a negative result is obtained in the first determination for the compatible standard.

7. The display device according to claim 1, wherein the timing controller selects one standard from among the plurality of standards according to a predetermined selection order.

8. The display device according to claim 7, wherein the selection order is an order stored in the storage unit, or an order in which information about each of the plurality of standards is stored in the storage unit.

9. The display device according to claim 1, wherein the storage unit further stores a priority of each of the plurality of standards, and the timing controller selects one standard from among the plurality of standards according to each of the priorities of the plurality of standards.

10. The display device according to claim 9, wherein, when the result of the first determination is positive and the priority of the selected standard is not the highest priority, the timing controller changes the priority of the selected standard to the highest priority.

11. The display device according to claim 1, wherein the information about each of the plurality of standards includes first information about training pattern data of each of the plurality of standards, and the timing controller generates training pattern data compatible with the selected standard based on the first information, and outputs the generated training pattern data to the source driver.

12. The display device according to claim 11, wherein the first information includes at least one of the number of packets, the number of bits per packet, and a data pattern of each packet of the training pattern data of each of the plurality of standards.

13. The display device according to claim 1, wherein the information about each of the plurality of standards includes second information about an image signal of a protocol of each of the plurality of standards, and the timing controller outputs an image signal of a protocol of the selected standard based on the second information to the source driver.

14. The display device according to claim 13, wherein the second information includes the number of bits of RGB image data for the protocol of each of the plurality of standards.

* * * * *